United States Patent [19]

Iizuka et al.

[11] Patent Number: 4,704,869

[45] Date of Patent: Nov. 10, 1987

[54] GAS TURBINE COMBUSTOR

[75] Inventors: Nobuyuki Iizuka; Fumiyuki Hirose; Isao Sato; Yoji Ishibashi, all of Hitachi, Japan

[73] Assignee: Hitachi, Ltd., Tokyo, Japan

[21] Appl. No.: 908,662

[22] Filed: Sep. 17, 1986

Related U.S. Application Data

[63] Continuation of Ser. No. 617,918, Jun. 6, 1984, abandoned.

[30] Foreign Application Priority Data

Jun. 8, 1983 [JP] Japan ..... 58-100730

[51] Int. Cl.[4] ..... F02C 1/00; F02G 3/00

[52] U.S. Cl. ..... 60/751; 60/760

[58] Field of Search ..... 60/754, 755, 756, 757, 60/760, 751, 752

[56] References Cited

U.S. PATENT DOCUMENTS

| | | | |
|---|---|---|---|
| 2,510,645 | 6/1950 | McMahan | 60/756 |
| 2,541,170 | 2/1951 | Mayers et al. | 60/752 |
| 3,756,020 | 9/1973 | Moskowitz et al. | 60/760 |
| 4,297,842 | 11/1981 | Gerhold et al. | 60/760 |

FOREIGN PATENT DOCUMENTS

| | | | |
|---|---|---|---|
| 857493 | 12/1960 | United Kingdom | 60/752 |

*Primary Examiner*—Louis J. Casaregola
*Assistant Examiner*—Timothy S. Thorpe
*Attorney, Agent, or Firm*—Antonelli, Terry & Wands

[57] ABSTRACT

A gas turbine combustor has a plurality of burner units each having an inner tube defining a combustion chamber therein and an outer tube surrounding the inner tube coaxially therewith. A fuel is injected into the head portion of the inner tube and is burnt in the combustion chamber to produce hot combustion gases which are guided through a tail tube to stationary blades of a gas turbine. Combustion air is supplied through an annular passage between the inner and outer tubes from the area around the tail tube to the head portion of the inner tube. A flow-uniformalizing tube is disposed between the inner and outer tubes to cooperate with the inner tube to define therebetween an air passage. The flow-uniformalizing tube imparts a greater flow resistance to air flow from the back side of the tail tube than to the air flow from the side thereof diametrically remote from the back side, so that the flow velocity of the air flowing through the air passage is substantially uniformalized in the circumferential direction of the inner tube.

1 Claim, 11 Drawing Figures

GAS TURBINE COMBUSTOR

This is a continuation of application Ser. No. 617,918, filed June 6, 1984, now abandoned.

FIELD OF THE INVENTION

The present invention relates to a gas turbine combustor and, more particularly, to a gas turbine combustor of the type in which the combustion air from a compressor flows through an annular passage between an inner tube and an outer tube in the direction opposite to the direction of flow of the combustion gases in the inner tube and is supplied into a combustion chamber in the inner tube through the head portion of the inner tube.

BACKGROUND OF THE INVENTION

As a measure for attaining higher efficiency of the operation of gas turbines, it has been proposed to operate the gas turbine at a higher temperature level of combustion gases than hitherto used The increased temperature of the combustion gases naturally raises the temperature of the combustor and lowers the durability of the combustor.

Figure 1:
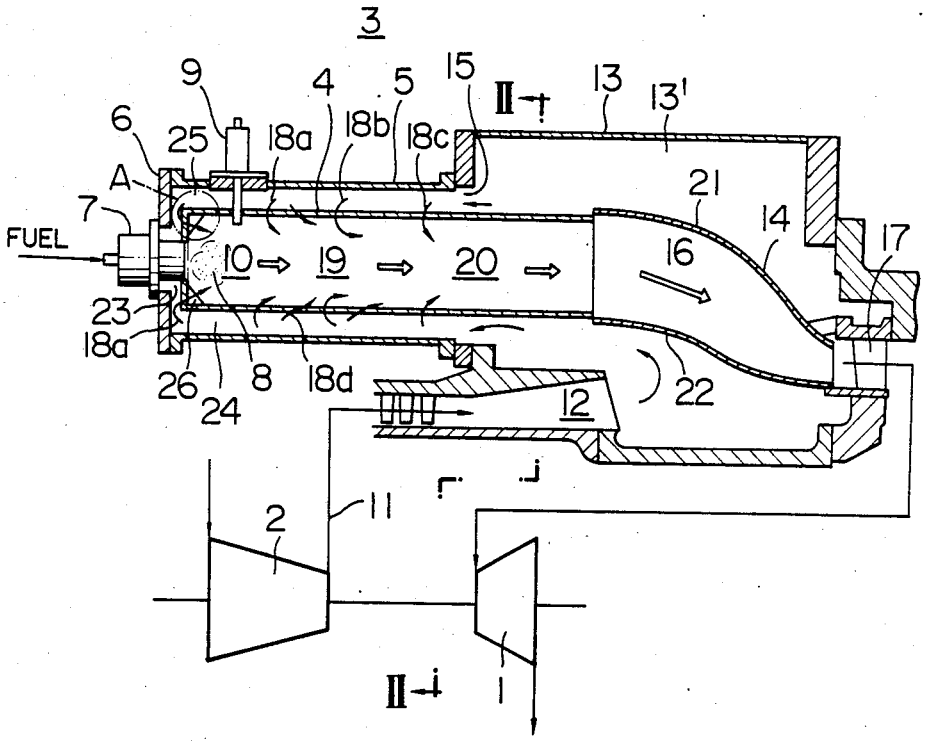
FIG. 1 PRIOR ART
FIG. 1 is a schematic partial axial sectional view of a known gas turbine combustor of a gas turbine plant.
Figure 2:
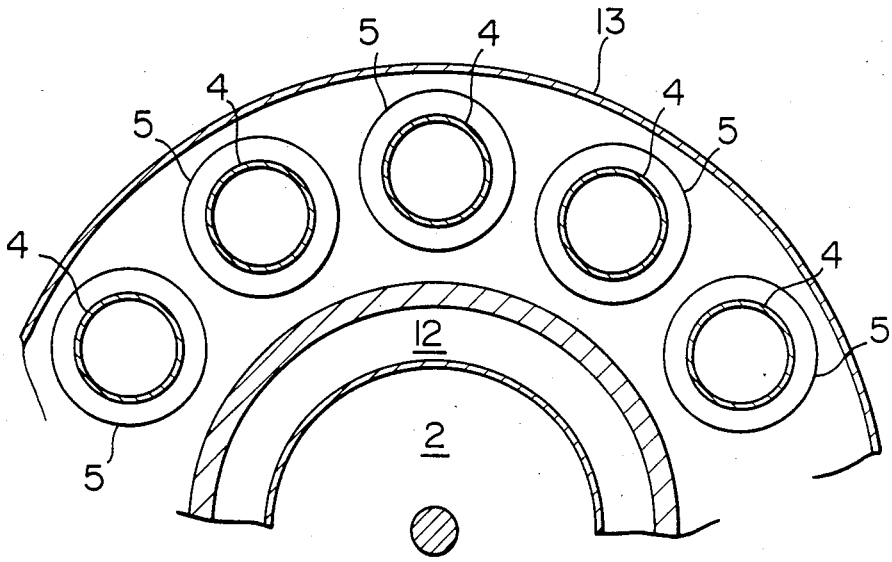
FIG. 2 PRIOR ART
FIG. 2 is a sectional view taken along the line II—II in FIG. 1.

FIGS. 1 and 2 show an essential part, i.e., a combustor of a known gas turbine system. The gas turbine system has a turbine 1, a compressor 2 mounted coaxially with the turbine, and a combustor 3. The combustible gas, which is the mixture of compressed air 11 supplied by the compressor 2 and a fuel injected from a nozzle 7, is burnt in the combustor 3 to produce hot combustion gases. The combustor 3 includes a plurality of burner units each of which has an inner tube 4, an outer tube 5 surrounding the inner tube 4, a nozzle 7 fixed to an end plate 6 of the outer tube 5 adjacent to the head end (left end as viewed in FIG. 1) thereof, a spark plug 9 and a tail tube 14 for guiding the hot combustion gases toward the turbine 1. The air 11 compressed by the compressor 2 is introduced through an air outlet 12 into an annular chamber 13' defined in an annular wall 13. After flowing around the tail tube 14, the air flows into an annular passage 15 defined between the outer tube 5 and the inner tube 4 and then passes through apertures 18 in the peripheral wall of the inner tube into the combustion chamber formed in the inner tube 4. The fuel is injected by the nozzle 7 into the combustion chamber and is diffused in the air to form a mixture which is burnt in the combustion chamber to produce combustion gases 16. The combustion gases 16 flow rightwards in the combustion chamber and are introduced through the tail tube 14, as indicated by thick arrows, into the gas turbine 1 past the stationary blades 17 of the gas turbine. More specifically, the air flowing into the combustion chamber through the head opening 18 of the inner tube 4 serves as primary air which atomizes and burns the fuel in the main combustion section 10. The air introduced through apertures **18*a* and 18*b* formed in the inner tube 4 and disposed downstream of the main combustion section 10 serves as secondary air which promotes the combustion of unburnt part of the mixture in an auxiliary combustion section 19. A dilution section 20 provided downstream of the auxiliary combustion section 19 is supplied with diluting air which is introduced through apertures 18*c* formed in the wall of the inner tube 4 downstream of the apertures 18*a* and 18*b*. Air for cooling the wall of the inner tube is introduced into the inner tube through a multiplicity of small louver ports 18*d* formed in the whole part of the peripheral wall of the inner tube 4**.

As shown in FIG. 2, the burner units each having the described construction are arranged around the compressor 2 to form the gas turbine combustor 3. This arrangement conveniently reduces the axial length of the gas turbine. In addition, since the compressed air flows in each burner unit through the annular passage between the outer and inner tubes from the area around the tail tube 14 towards the head of the combustor while cooling the wall surface of the inner tube, the air is preheated before it enters the combustion chamber, so that the thermal efficiency of the gas turbine is improved appreciably. For these reasons, this type of gas turbine combustor is now widely used.

This known gas turbine combustor, however, suffers from a disadvantage that, since the compressed air supplied by the compressor 2 makes a substantially 180° turn in the annular chamber 13', a non-uniform flow velocity distribution of air is caused in the annular passage 15, so that the wall of the inner tube is locally heated undesirably. More specifically, since the air flowing into the annular passage 15 from the air outlet 12 makes a substantially 180° turn in the annular chamber 13' and since a part of the air flows along the "back" or outer side 21 of the tail tube 14, the velocity of the air is higher at the outer side 21 of the tail tube 14 than at the lower or inner side 22 which is closer to the air outlet 12 than the outer side 21. This non-uniform flow velocity distribution adversely affects the flow of air in the annular passage 15 between the inner and outer tube such that, in the region of annular passage 15 adjacent to the tail tube 14, the air flow velocity is higher at the upper side of the inner tube 4 than at the lower side thereof whereas, in the region of the annular passage 15 adjacent to the head portion 23, a higher air flow velocity is caused in the area 24 below the inner tube 4 due to the influence of the flow of air around the outer side or back of the tail tube 14.

The high flow velocity of air in the area 24 below the inner tube 4 at the head portion produces, in a region in the upper side 25 of the combustion section 10 as marked by A, a flow component opposite to the flow of air coming from the annular chamber 13' into the annular passage 15. Consequently, a small area of stagnation of air is formed at the upper side 25 of the inner tube 4 in the region adjacent to the head of the inner tube 4. As a result, the air is supplied at higher velocity to the lower part (as viewed in FIG. 1) of the main combustion section in the inner tube 4 than to the upper part thereof, so that the flame formed in the head portion of the combustion chamber is deflected towards the upper part (as viewed in FIG. 1) of the inner peripheral surface of the inner tube 4. In particular, in the upper part of the inner tube cap 26, the flame attaches to the wall due to an extremely small velocity of the air fed into the combustion chamber. Therefore, the upper part of the inner tube cap 26 and the upper part of the inner tube 4 adjacent to the head end are locally overheated, so that the local part of the inner tube 4 is damaged, resulting in a shorter life of the combustor.

In order to avoid this problem, the combustor has been operated at a temperature which is low enough to prevent the combustor from being completely damaged despite local overheating.

If the problem attributable to the local overheating of the combustor is overcome, it will become possible to operate the combustor at a higher temperature without increasing the size of combustor.

It is to be noted also that, since there is difference in air flow velocity between the upper and lower zones of the combustion chamber in the inner tube 4, an irregularity of air-fuel ratio is caused across the combustion chamber even though the fuel is uniformly injected into the inner tube. The irregular air-fuel ratio causes a non-uniform combustion in the combustion chamber resulting in strong combustion vibration and formation of a hot spot which leads to the production of nitrogen oxides.

SUMMARY OF THE INVENTION

Accordingly, it is an object of the invention to provide a gas turbine combustor improved to suppress the occurrence of non-uniform or irregular flow of air in the annular passage thereby preventing the undesirable local overheating of the combustor.

According to the present invention, a tubular flow-uniformalizing member is provided between the inner and outer tubes to assure a substantially uniform air flow velocity distribution in the circumferential direction of the annular air flow passage between the inner tube and the flow-uniformalizing member. The flow-uniformalizing member is shaped such that it provides a greater flow resistance at its side adjacent to the back of the tail tube and a smaller air flow resistance at the side of the flow-uniformalizing member diametrically remote from the tail tube back whereby the velocities of air flows at both sides of the flow-uniformalizing member are substantially equalized to ensure the circumferentially uniform air flow velocity distribution.

The above and other objects, features and advantages of the invention will be made more apparent by the following description with reference to FIGS. 3–11.

DESCRIPTION OF PREFERRED EMBODIMENTS

Figure 3:
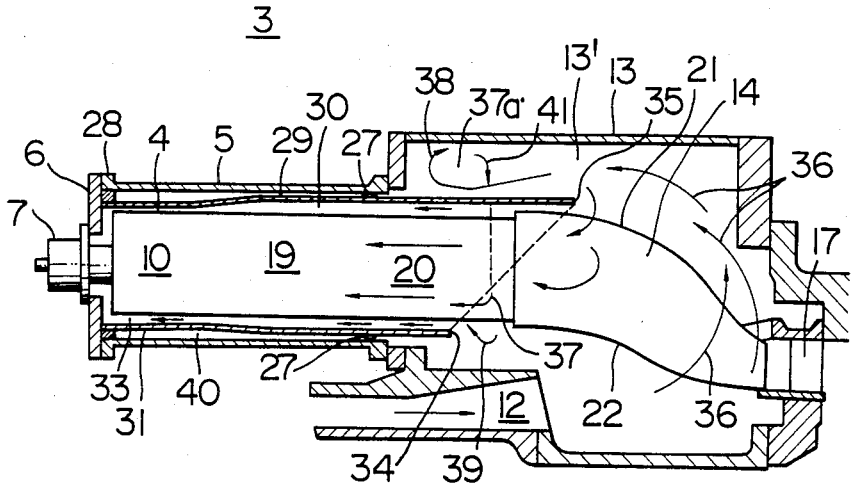
FIG. 3 is a fragmentary axial partial sectional view of a gas turbine combustor embodying the present invention.

FIG. 3 shows an embodiment of the gas turbine combustor in accordance with the invention. As in the case of the prior art combustor, this embodiment has a plurality of burner units each of which has inner tube 4, outer tube 5, fuel nozzle 7 and tail tube 14 substantially identical to those of the prior art combustor shown in FIG. 1. However, in order to prevent the undesirable non-uniform flow of air in the passage 15 due to the air flow around the back of the tail tube 14, the combustor embodying the invention is provided with a flow-uniformalizing tube 29 which extends axially through the annular passage 15 over the inner tube 4 to above the end portion of the tail tube 14 adjacent to the inner tube 4 such that a space is defined between the outer and inner surfaces of the tubes 4 and 29. The flow-uniformalizing tube 29 is provided at its head portion with an integral flange 28 by means of which the tube 29 is fixed to the end plate 6, while the other end, i.e., the right-side end as viewed in FIG. 3, of the flow-uniformalizing tube 29 is supported by the inner surface of the outer tube 5 through a plurality of circumferentially spaced leaf springs 27. The flow-uniformalizing tube 29 is disposed concentrically to the inner tube 4. The flow-uniformalizing tube 29 includes a portion 31 adjacent to its end fixed to the end plate 6 and extending around the main combustion section 10. This portion 31 has a reduced diameter to define a narrow annular space 33 around the inner tube 4. This narrow space 33 has a cross-sectional area which is just sufficient to maintain the required flow rate of air supplied to the main combustion section 10. On the other hand, the portion of the flow-uniformalizing tube 29 extending around the auxiliary combustion section 19 and the dilution section 20 has a greater diameter than the first-mentioned portion 31 so as to form an annular space 30 around the inner tube 4, the space 30 having a cross-sectional area which is larger enough to allow all the air supply not only to the auxiliary combustion section 19 and the dilution section 20 but also to the main combustion section 10. The free or upstream end portion of the flow-uniformalizing tube 29 as viewed in the direction of flow of air extends into the annular chamber 13' and has an oblique end extremity such that the upper side 35 of the end extremity extends above a part of the back of the tail tube 14 while the lower side 34 of the end extremity projects into the chamber 13' only slightly.

A major part 36 of the combustion air flowing into the annular chamber 13' from the air outlet 12 flows around the outer peripheral surface of the tail tube 14 and is concentrated to the area behind or above the back 21 of the tail tube 14. Since the upper side 35 of the end surface of the flow-uniformalizing tube 29 projects into the area above the back 21 of the tail tube 14, a part of the air concentrated to this area flows into the annular passage 30 between the flow-uniformalizing tube 29 and the inner tube 4, while the rest of the air flows into a space **37*a* formed between the wall 13 defining therein the annular chamber 13' and the flow-uniformalizing tube 29. This part of the air is turned downwardly as indicated by arrows 38 and 41 and then flows into the annular passage 30 as indicated by arrows 37 and 39. Consequently, the portion of the annular passage 30 closer to the back 21 of the tail tube 14 imparts flow resistance which is apparently greater than that of the portion of the annular passage 30 adjacent to the under side 22 of the tail tube 14. It is, therefore, possible to obtain a substantially equal flow velocities of air through both portions of the annular passage 30. The degree or extent of concentration of air to the area above the back 21 of the tail tube 14 varies depending on the factors such as the velocity of the air flow from the air outlet 12 into the chamber 13', the size of the annular chamber 13' and so forth. Thus, the extensions of the upper and lower sides 35 and 34 of end surface of the flow-uniformalizing tube 29 are suitably determined by measuring the flow-velocity distribution in the annular passag 30** and adjusting the extensions such that the difference in flow velocities falls within a predetermined allowable range.

An annular space 40 formed between the flow-uniformalizing tube 29 and the outer tube 5 functions as a heat-insulating space to reliably prevent the temperature rise of tne outer sleeve 5.

Figure 4:
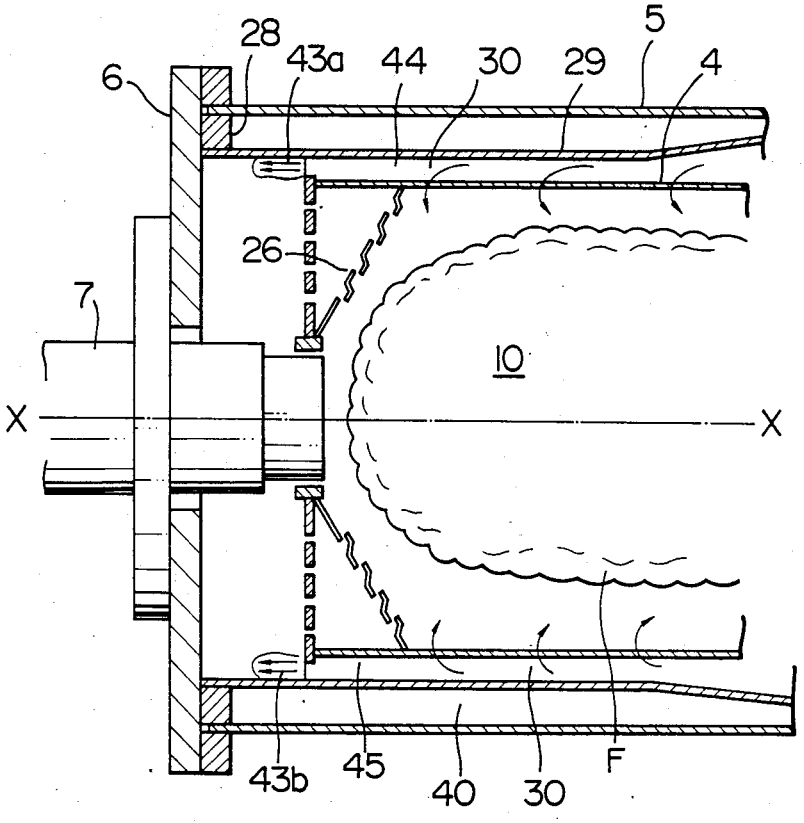
FIG. 4 is an enlarged fragmentary sectional view of the combustor illustrating the state of combustion in the head portion of the combustor.

FIG. 4 shows the state of combustion in the main combustion section 10 in the combustor shown in FIG. 3. The velocity of air flowing through the upper portion of the annular passage 30, as represented by arrows 43*a*, is substantially equal to that of the air flowing through the lower portion of the annular passage 30 represented by arrows 43*b*. In addition, the flow of air into the main combustion section 10 through the wall of the inner tube 4 is substantially uniform over the entire circumference of the inner tube. Consequently, the flame F is formed substantially symmetrically with respect to the axis X—X and spaced from the inner surface of the inner tube 4. Thus, the undesirable local overheating of the inner tube 4 is avoided advantageously. Furthermore, the combustion is stabilized and the unfavourable combustion vibration is suppressed due to the substantially uniform supply of the air through the entire circumference of the wall of the inner tube 4.

Figure 5:
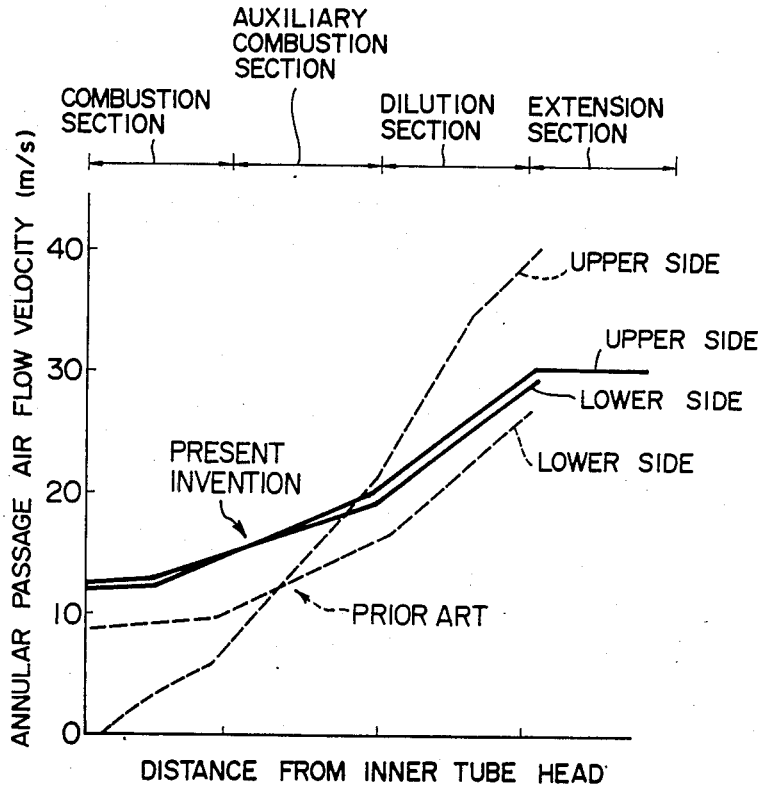
FIG. 5 is a graph showing air flow velocity distributions in an annular passage formed in the combustor.

The flow velocities of air in the upper and lower portions of the annular passages of the prior art combustor shown in FIG. 1 and of the combustor of the described embodiment of the invention shown in FIG. 3 were measured, with results shown in FIG. 5, in which the full-line curves show the flow velocities of air in the combustor shown in FIG. 3 while the broken-line curves show the flow velocities of air in the prior art combustor. It will be seen that, in the combustor of the invention, the difference in air flow velocity between the upper and the lower portions of the annular passage 30 is very small over the entire length of the inner tube 14. In contrast, the prior art combustor exhibits a larger difference in air flow velocity. Namely, in the region of the annular passage 15 (FIG. 1) adjacent to the tail tube 14, the flow velocity is much higher in the upper portion than in the lower portion, whereas, in the region adjacent to the head of the inner tube 4, the flow velocity in the lower portion of the annular passage 15 is much higher than that in the upper portion of the same passage 15 although the flow velocities are equal in the region around the auxiliary combustion section. In the prior art combustor, therefore, a large difference in flow velocities of air is caused between the upper and lower portions of the other sections of the annular passage, so that the air flows through the apertures 18*a* to 18*d* formed in the inner tube at different rates. This difference of the air flow rate is one of the major causes of the local overheating of the prior art combustor.

In sharp contrast, in the combustor embodying the invention, the difference in the air flow velocities between the upper and lower portions of the annular passage 30 is so small in every sections thereof that the air is supplied substantially uniformly through the entire circumference of the peripheral wall of the inner tube 4 to suppress the radial deflection or offset of the flame and the combustion vibration.

The embodiment of the combustor shown in FIG. 3 can be realized without requiring substantial change of the design of the conventional combustors. Namely, this embodiment of the combustor can easily be obtained simply by inserting and fixing to an existing combustor a flow-uniformalizing tube 29 having an oblique end surface.

Figure 6:
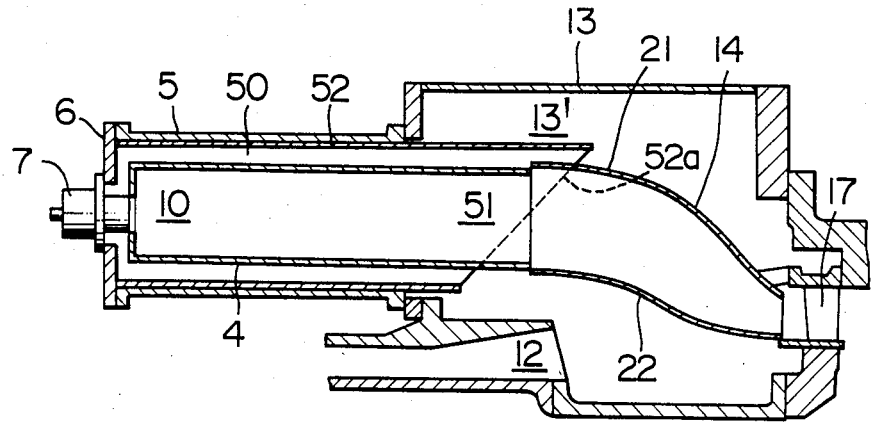
FIGS. 6 and 7 are fragmentary axial sectional views of other embodiments of the combustor.

FIG. 6 shows another embodiment of the gas turbine combustor of the invention. This embodiment is distinguished from the embodiment shown in FIG. 3 in that a flow-uniformalizing tube 52 directly engages with the inner peripheral surface of the outer tube 5 so that the heat insulating space 40 of the embodiment shown in FIG. 3 is eliminated. As in the case of the embodiment shown in FIG. 3, the flow-uniformalizing tube 52 has an oblique end surface 52*a* having the upper portion adjacent to the tail tube 14 extending deeper into the annular chamber 13' than the lower portion adjacent to the under side 22 of the tail tube. The effect of uniformalization of the air flow velocity distribution in an annular space 50 between the inner tube 4 and the outer tube 52 is substantially equal to that of the embodiment shown in FIG. 3. In addition, since the heat insulation space 40 in the embodiment shown in FIG. 3 is eliminated, the cross-sectional area of the annular passage 50 is correspondingly increased with resultant decrease in the flow resistance along the annular passage 50 and simplification of the structure for supporting the flow-uniformalizing tube 52.

Figure 7:
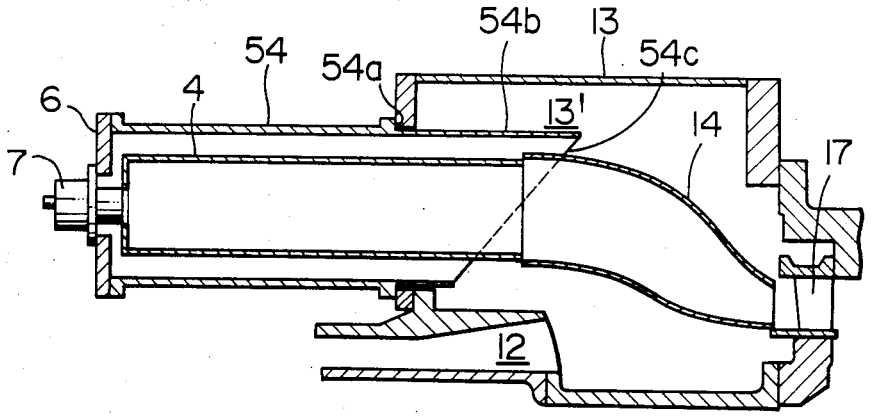

FIG. 7 shows still another embodiment of the gas turbine combustor of the invention, in which the number of component parts is decreased by integrating the flow-uniformalizing tube and the outer tube into a single element. Namely, an outer tube 54 has an integral portion 54*b* extending into the chamber 13' beyond a flange 54*a* by which the tube 54 is connected to the wall 13. The portion 54*b* of the outer tube 54 forms a flow-uniformalizing tube which has an oblique end surface 54*c* as in the case of the preceding embodiments.

Figure 8:
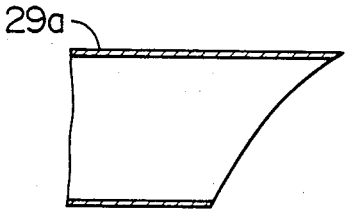
FIGS. 8 and 9 are sectional views of modified flow-uniformalizing tubes.
Figure 9:
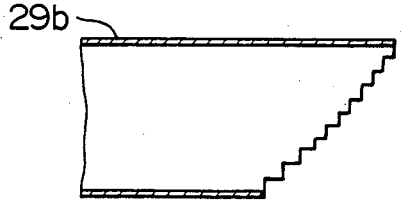

In each of the embodiments shown in FIGS. 6 and 7, the flow-uniformalizing tube 52 or 54*b* has an end surface which extends in a plane oblique to the axis of the tube. This feature, however, is not exclusive. Oblique end surfaces of modified flow-uniformalizing tubes 29*a* and 29*b* shown in FIGS. 8 and 9 are respectively curved and provided with steps at small pitches. In either case, it is necessary that the upper portion of the end surface adjacent to the back 21 of the tail tube 14, i.e., adjacent to the area in which the air flows at greater velocity into the annular passage, projects deeper into the annular chamber 13' than the portion of the end surface adjacent to the under side 22 of the tail tube 14.

In the gas turbine combustor of the invention, a plurality of burner units are arranged on a circle around the compressor 2 as will be seen in FIG. 2. Therefore, the projected portion of the end surface of the flow-uniformalizing tube adjacent to the back 21 of the tail tube 14 of each burner is located at the radially outermost portion of the combustor farthest from the center of the compressor 2, i.e., from the axis of the turbine.

Figure 10:
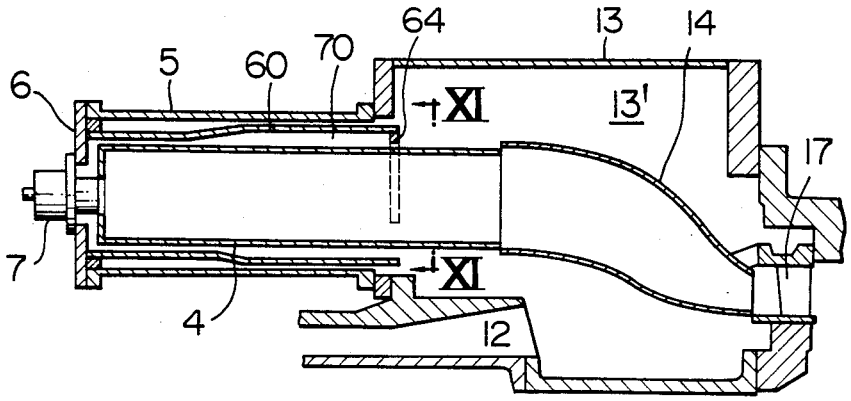
FIG. 10 is a fragmentary axial sectional view of still another embodiment of the combustor.
Figure 11:
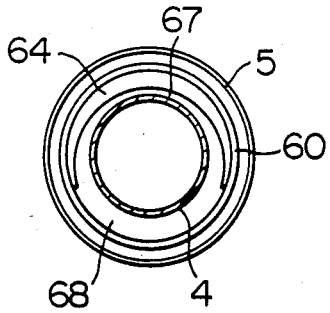
FIG. 11 is a sectional view taken along the line XI—XI in FIG. 10.

FIG. 10 shows a further embodiment of the invention, in which a flow-uniformalizing tube 60 does not extend into the annular chamber 13' but is provided with a crescent damper plate 64 to establish a difference in the sectional area of the inlet to an annular passage 70, between the upper and lower sides of the inner tube 4. More specifically, as will be clearly seen in FIG. 11, the damper plate 64 provides a smaller inlet area 67 at the upper side of the inner tube 4 adjacent to the back of the tail tube 14 than an inlet area 68 at the lower side of the annular passage. The damper plate 64 is operative to uniformalize the velocities of different streams of air from the chamber 13' into the annular passage 70. The velocity of the upper stream of the air is increased by the narrower inlet area 67 as compared with the portion of the air passing through the wider inlet area 68. However, since the annular passage 70 has equal cross-sectional areas at the upper and lower sides of the inner tube 4, the velocity of the portion of the air flow along the upper side of the inner tube 4 and having the increased flow velocity is decreased because the cross-section of the passage 70 is increased downstream of the inlet area 67. Consequently, a uniform flow velocity of air is obtained at the upper and lower sides of the inner tube 4 downstream of the damper plate 64.

The damper plate 64 may be clamped between the outer tube 5 and the annular flange provided on the left end of the annular chamber wall 13. In such a case, the flow-uniformalizing tube 60 may be omitted. Since the damper plate 64 provides a local restriction of the cross-sectional area of the air passage, the flow velocity of air is further increased at this restriction. So, it is somewhat difficult to uniformalize the flow-velocity distribution in the circumferential direction over the entire length of the annular passage around the inner tube. This arrangement, however, can be used practically in a combustor whose performance is not so much adversely affected by a slight non-uniformity of flow-velocity distribution in the region around the dilution section of the combustion chamber.

It is possible to provide a crescent damper plate on the flow-uniformalizing tube 29 of the embodiment shown in FIG. 3. With such an arrangement, it is possible to further uniformalize the flow-velocity distribution.

As has been described, according to the invention, it is possible to attain a substantially uniform flow-velocity distribution in the annular passage over the entire circumference of the inner tube and, hence, to avoid the undesirable deflection or offset of the flame attributable to lack of uniformity of flow-velocity distribution. Consequently, the local overheating of the inner tube of the combustor is prevented to permit the gas turbine combustor to operate at a higher temperature of the combustion gases. In addition, the stability of the flame is increased and the combustion vibration is decreased due to the elimination of local concentration of the combustion air.

What is claimed is:

1. In a gas turbine combustor including a plurality of burner units arranged around an axis of a compressor, each burner unit having an inner tube provided with air ports formed in the wall thereof, an outer tube surrounding said inner tube, a fuel nozzle for supplying a fuel into a head portion of said inner tube, a tail tube for guiding combustion gases produced in said inner tube to stationary blades of an associated gas turbine, an annular air passage formed between said inner tube and said outer tube, an annular chamber formed around said tail tube and communicating with said annular air passage through a substantially circular air inlet, and means for providing communication between an air outlet of said compressor and said annular chamber, said communication means being nearer to the compressor axis, radially thereof, then said inner tube, said air inlet including first and second areas, said first area being more remote from said axis, radially thereof, than said second area, and a flow-uniformalizing tube disposed adjacent to said air inlet to said annular passage and around said inner tube and extending into said annular chamber, said flow-uniformalizing tube having an end extremity disposed in said annular chamber, said end extremity being generally oblique relative to the axis of said inner tube and arranged such that said flow-uniformalizing tube extends deeper into said annular chamber in said first area of said air inlet than in said second area thereof to impart a greater flow resistance to the flow of air in said first area of said air inlet than in said second area of said air inlet.

* * * * *